US011533947B2

(12) United States Patent
Nakash et al.

(10) Patent No.: US 11,533,947 B2
(45) Date of Patent: Dec. 27, 2022

(54) MULTI-LAYERED TOBACCO CAPSULE FOR HOOKAH

(71) Applicants: Avichai Nakash, Ashdod (IL); Yaniv Shimon Azrane, Ashdod (IL); Daniel Tolmasov, Ashdod (IL)

(72) Inventors: Avichai Nakash, Ashdod (IL); Yaniv Shimon Azrane, Ashdod (IL); Daniel Tolmasov, Ashdod (IL)

( * ) Notice: Subject to any disclaimer, the term of this patent is extended or adjusted under 35 U.S.C. 154(b) by 85 days.

(21) Appl. No.: 16/632,539

(22) PCT Filed: Feb. 17, 2019

(86) PCT No.: PCT/IL2019/050187
§ 371 (c)(1),
(2) Date: Jan. 21, 2020

(87) PCT Pub. No.: WO2019/167038
PCT Pub. Date: Sep. 6, 2019

(65) Prior Publication Data

US 2021/0161199 A1 Jun. 3, 2021

(30) Foreign Application Priority Data

Feb. 28, 2018 (IL) ..... 257805

(51) Int. Cl.
*A24D 1/14* (2006.01)
*A24F 1/30* (2006.01)

(52) U.S. Cl.
CPC . *A24D 1/14* (2013.01); *A24F 1/30* (2013.01)

(58) Field of Classification Search
CPC ..... A24D 1/14; A24F 1/30
See application file for complete search history.

(56) References Cited

U.S. PATENT DOCUMENTS

2007/0215164 A1* 9/2007 Mehio ..... A24F 1/30 131/173
2010/0101590 A1* 4/2010 Pflaum ..... A24F 1/30 131/222
2019/0124977 A1* 5/2019 Bonnely ..... A24D 1/22
2019/0297938 A1* 10/2019 Sidani ..... A24D 1/14

FOREIGN PATENT DOCUMENTS

EP 2179667 A1 4/2010

* cited by examiner

*Primary Examiner* — Cynthia Szewczyk

(57) ABSTRACT

A multi-layered tobacco capsule for hookah that includes a container with an upper surface, a lower surface and sidewalls defining an enclosed internal volume. The upper and lower surface includes a plurality of apertures for allowing airflow through the capsule. The container includes one, or more, grids that separate the container to two or more inner compartments. The inner compartments include a quantity of tobacco. The capsule is designed to be positioned onto or inside a cup of the hookah. The capsule may include removable sealing mean that cover the apertures.

2 Claims, 7 Drawing Sheets

MULTI-LAYERED TOBACCO CAPSULE FOR HOOKAH

RELATED APPLICATIONS

This application is a National Phase of PCT Patent Application No. PCT/IL2019/050187 having International filing date of 17 Feb. 2019, which claims the benefit of priority of Israeli patent application No. 257805 filed on Feb. 28, 2018. The contents of the above applications are all incorporated by reference as if fully set forth herein in their entirety.

TECHNICAL FIELD

The present invention refers to a multi-layered tobacco capsule for hookah.

BACKGROUND ART

The use of the smoking instrument that is depicted at FIG. 1 is much known in the world, and this instrument is named as hookah, shisha and other names in different places in the world, and in the present patent application we will name it as hookah. The hookah (100) is an instrument for smoking tobacco whose smoke is passed through a water basin, often glass-based, before inhalation. Traditionally, the user or the expert who prepares the hookah for the smoking action places tobacco into a cup (101) located at the top of the hookah (100), covers the cup with foil, punches holes in the foil, lays on it a burning coal and sets it up to start the tobacco combustion action. The actions for cleaning the cup from the remains of burnt tobacco ash, placing new tobacco into the cup, covering it with foil, and punching the foil for preparing it for the act of smoking are cumbersome, time-consuming, and not every user knows how to do them properly. Several types of capsules that include tobacco are known and the use of these capsules overcome said disadvantageous.

However, the smoking action of the hookah, according the tradition way or by using the known capsules, cause the same following problem: The user's suction action during the smoking of the hookah (100) causes the tobacco to be compressed at the bottom of the capsule, and when the tobacco is compressed, not all of the tobacco burns in contact with air, that results with heavy white smoke that causes discomfort to the user's throat. The present patent application discloses a multi-layers tobacco capsule for hookah that is designed to overcome this disadvantage of the prior art.

DESCRIPTION OF THE DRAWINGS

The intention of the drawings attached to the application is not to limit the scope of the invention and its application. The drawings are intended only to illustrate the invention and they constitute only one of its many possible implementations.

THE INVENTION

Figure 1:
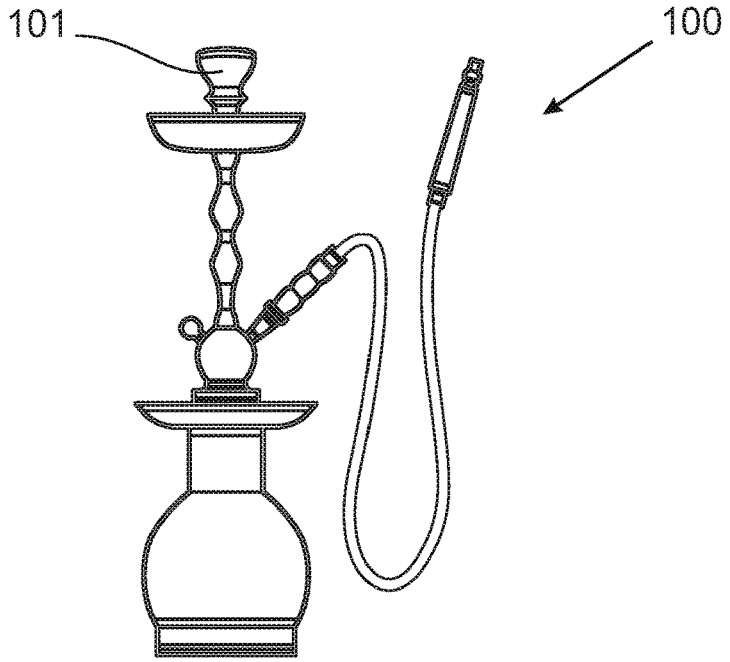
FIG. 1 depicts the hookah (100) that includes the top cup (101).

The object of the present invention is to provide a multi-layered tobacco capsule for hookah (1) that includes two or more inner compartments, for enabling smooth and comfort smoke of the hookah.

The multi-layered tobacco capsule (1) comprises a container (11) having an upper surface (12), a lower surface (13) and sidewalls (14) defining an enclosed internal volume. The upper and the lower surfaces further comprise a plurality of apertures (15) for allowing airflow through the capsule (1). The container (11) includes a grid (16) that separates the container (11) to two compartments (111) (112). The compartments (111) (112) includes a quantity of tobacco (17). It is possible that the container (11) may include few grids and by that to divide the container to several compartments. The capsule (1) is designed to be positioned onto the cup (101) at a top of the hookah (100).

It is preferably that the capsule will be made of a foil, preferably that the foil thickness of the sidewalls (14) will be of 1050H24 millimeters, and the upper surface (12) of 3003H22 millimeters. However, the invention are relates to any kind of thickness and any kind of materials. It is preferably that the grid (16) will be made of metal string with diameter of 0.4 millimeters and that its pores will be 3×3 millimeters in area. In addition, it is preferably that the container (11) of the capsule (1) will includes steps (3) on which the grids (16) will be positioned, ad depicted for example in FIG. 14, that the height from the lower surface (13) to the lower step (3) will be 9.5 millimeters, that the height from the lower surface (13) to the upper step (3) will be 22.1 millimeters, and that that the height from the lower surface (13) to the top surface (12) will be 25.5 millimeters, as depicted for example in FIG. 12. This sizes numbered as A, B and C in FIG. 12. It is also preferably that the volume of the capsule (1) will 34 cc and that it will includes 10.6 gram of tobacco (17).

It is preferably that the apertures (15) will be covered by a removable sealing means (18), preferably silicone, that prevent air to come into the capsule during storage for preserving the freshness of the tobacco, and the user can remove these sealing means before use.

The fact that the tobacco (17) is placed in two separate compartments (111) (112) separated by the grid (16) prevents it from being compressed into the bottom of the container (11), so that when it burns, the tobacco comes into direct and efficient contact with air, preventing the creation of white smoke that bums the user's throat. Due to the positions of the grid (16) or girds in the capsule (1), as depicted for example in FIG. 14, the tobacco (17) between the top surface (12) to the upper grid (16) burned first, after that the tobacco between the grids and then after the tobacco under the lower grids. Thus, during all the smocking the user feel a burn of fresh tobacco, unlike when using standard capsules in which all the tobacco is burned at once.

Figure 2:
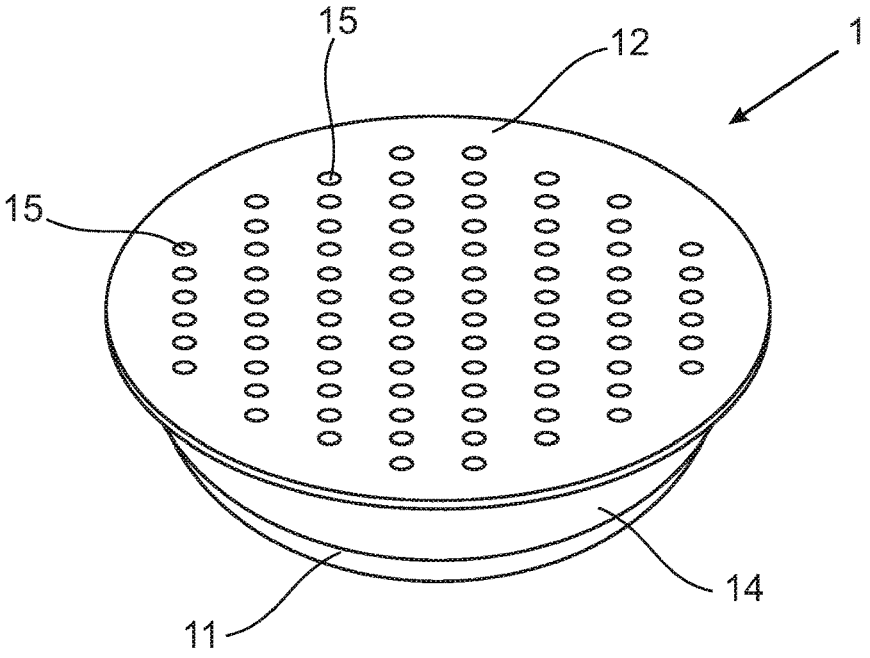
FIG. 2 depicts the multi-layered tobacco capsule (1).
Figure 3:
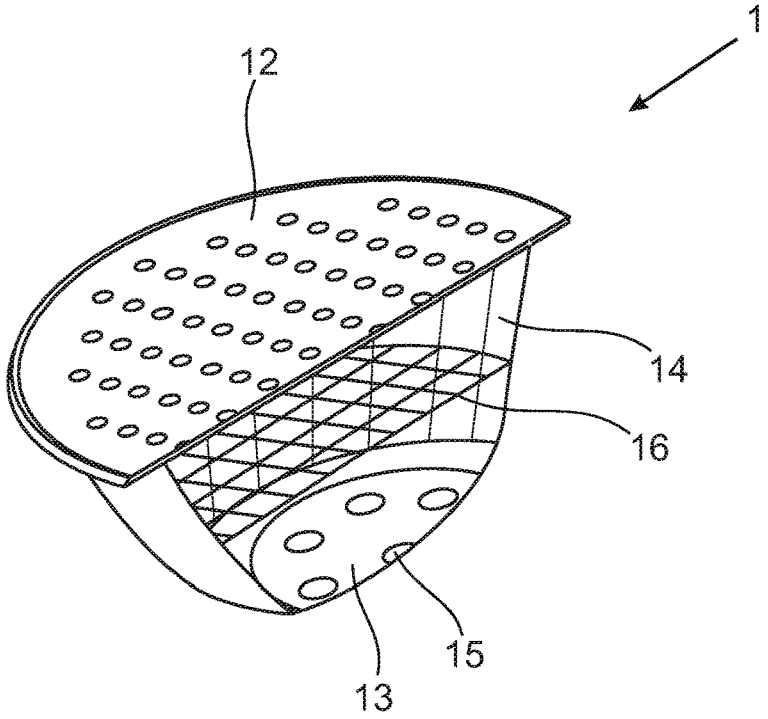
FIG. 3 is a perspective cross section of the multi-layered tobacco capsule (1).
Figure 4:
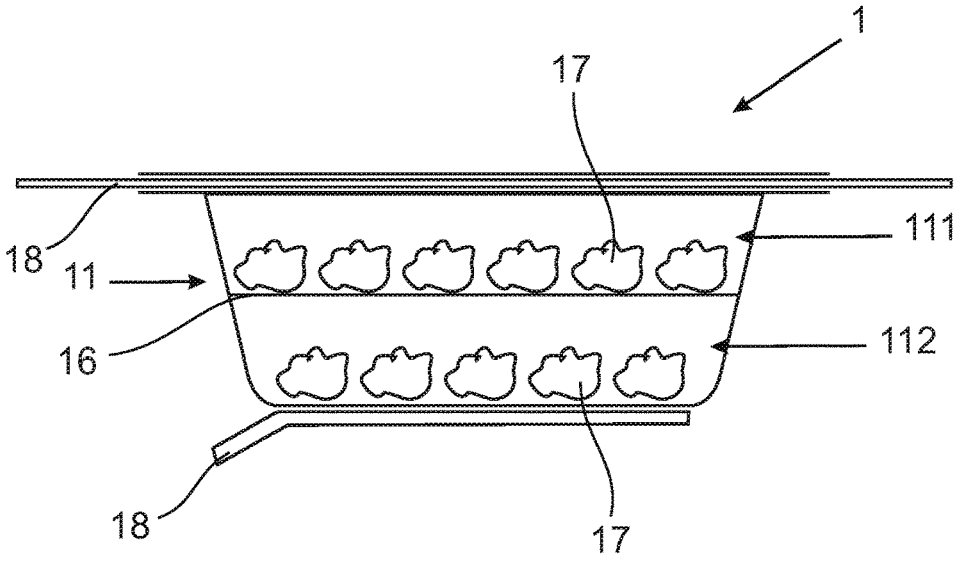
FIG. 4 is a side cross section of the multi-layered tobacco capsule (1).

FIG. 1 depicts the hookah (100) that includes the top cup (101). FIG. 2 depicts the multi-layered tobacco capsule (1). FIG. 3 is a perspective cross section of the multi-layered tobacco capsule (1). FIG. 4 is a side cross section of the multi-layered tobacco capsule (1).

It is also possible to sell and market the capsule in a casing (2) with several capsules (1) and also with a top cup (101) to which the capsule will be fitted. Usually every hookah (100) equipped with a conic narrow top pipe (102) on which a top cup is assembled. The top cup (101) that may be accompanied with the capsules (1) in the casing (2) will be fit to top pipes (102) of almost every hookah (100) and the fact that the capsule (1) is fitted by its geometry to the inner cone (103) of the top cup (101) make the invention more efficient.

Figure 6:
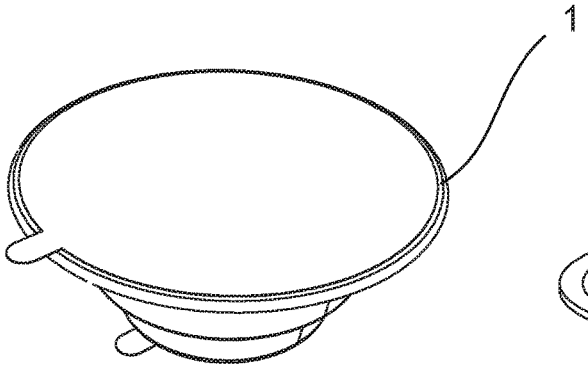
FIG. 6 depicts the capsule (1) when it closed.
Figure 7:
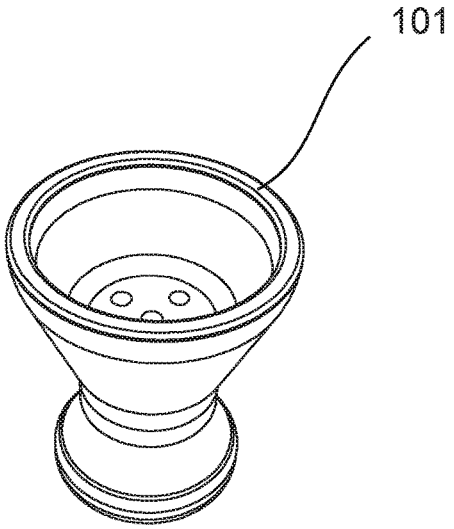
FIG. 7 depicts the top cup (101).
Figure 8:
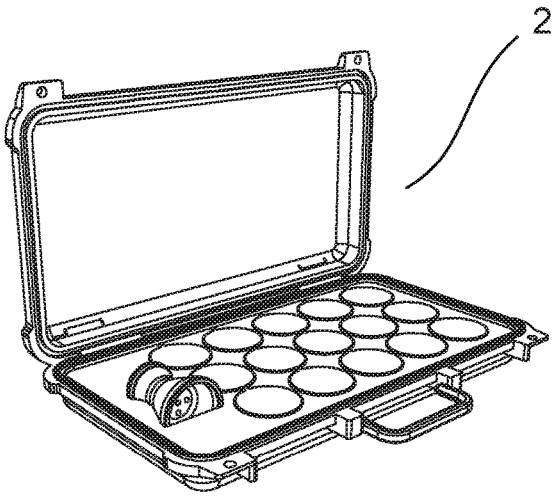
FIG. 8 depicts the casing (2) that include several capsules and one top cup.
Figure 5:
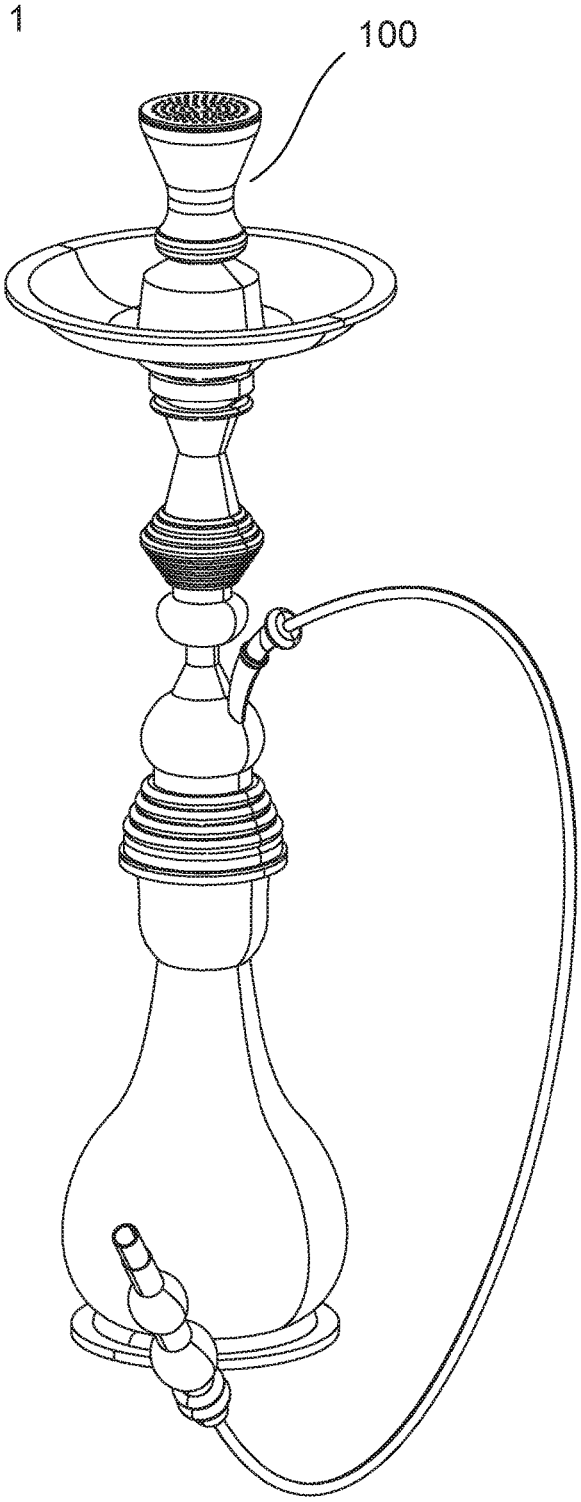
FIG. 5 depicts the hookah (100) on which the capsule (1) is assembled.
Figure 9:
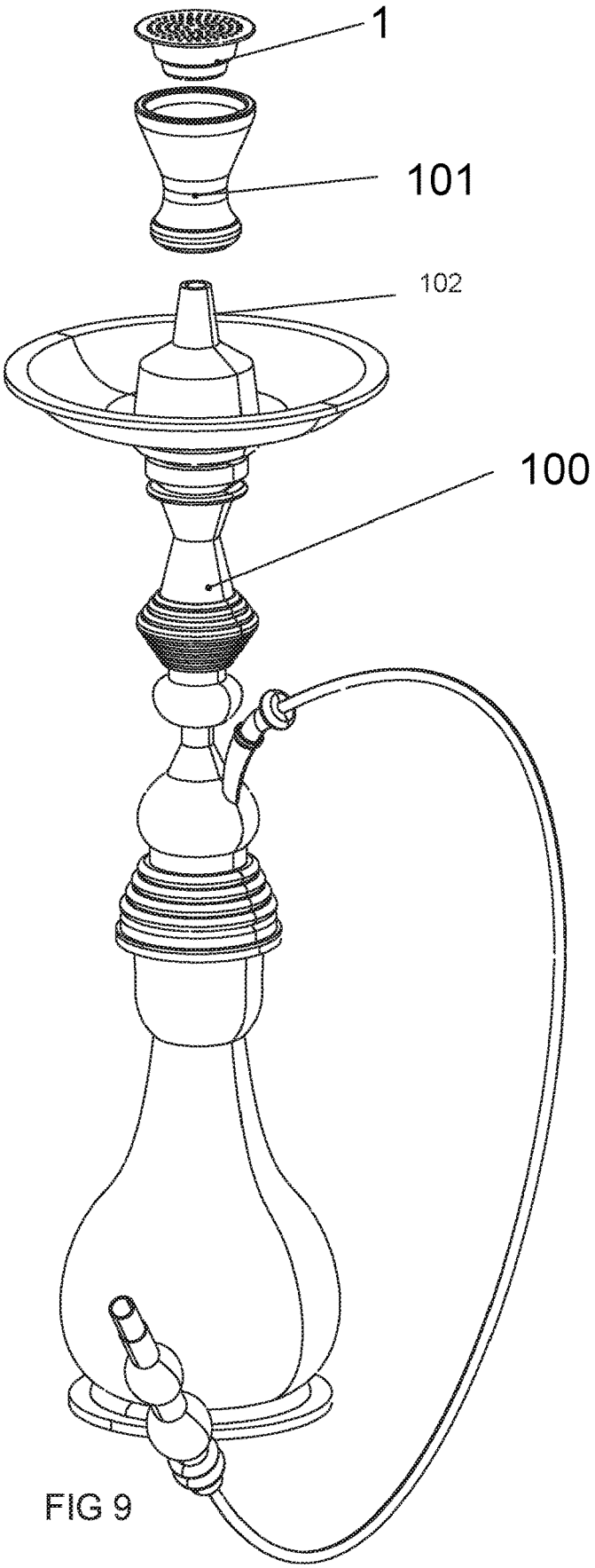
FIG. 9 is an exploded depiction of the hookah (100), the top cup (101) and the capsule (1).
Figure 10:
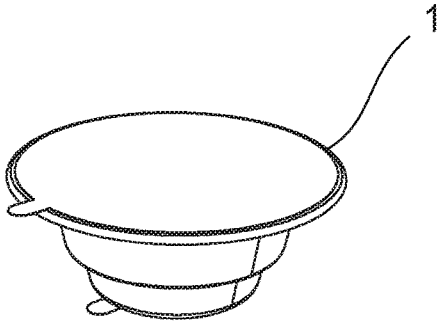
FIG. 10 depicts the capsule (1) when it is closed.
Figure 11:
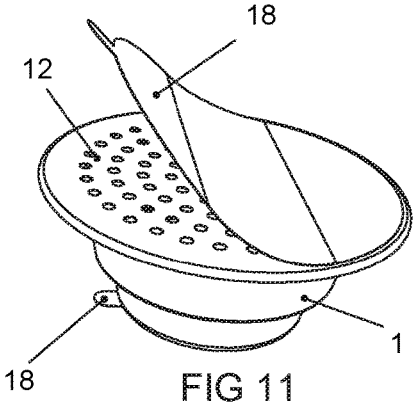
FIG. 11 depicts the capsule (1) when the removable sealing means (18) on its top is partially removed.
Figure 12:
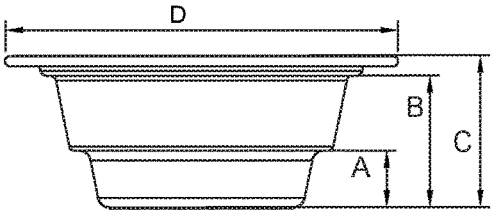
FIG. 12 is a side view depiction of the capsule (1).
Figure 13:
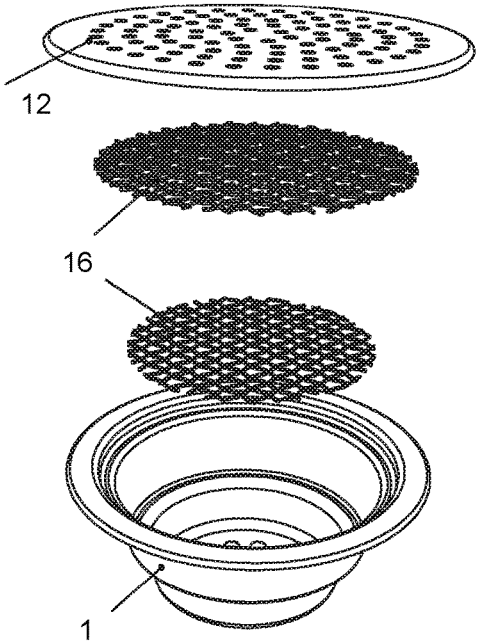
FIG. 13 is an exploded depiction of the capsule (1), its grids (16) and the upper surface (12).
Figure 14:
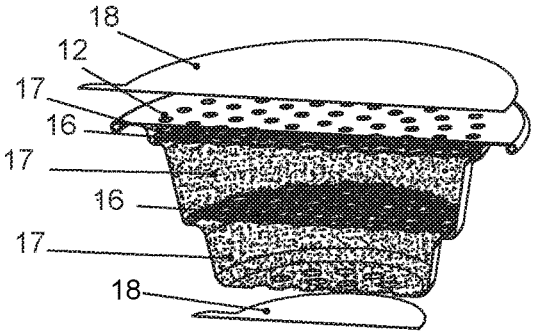
FIG. 14 is a sided cross-sectional view of the capsule (1).
Figure 15:
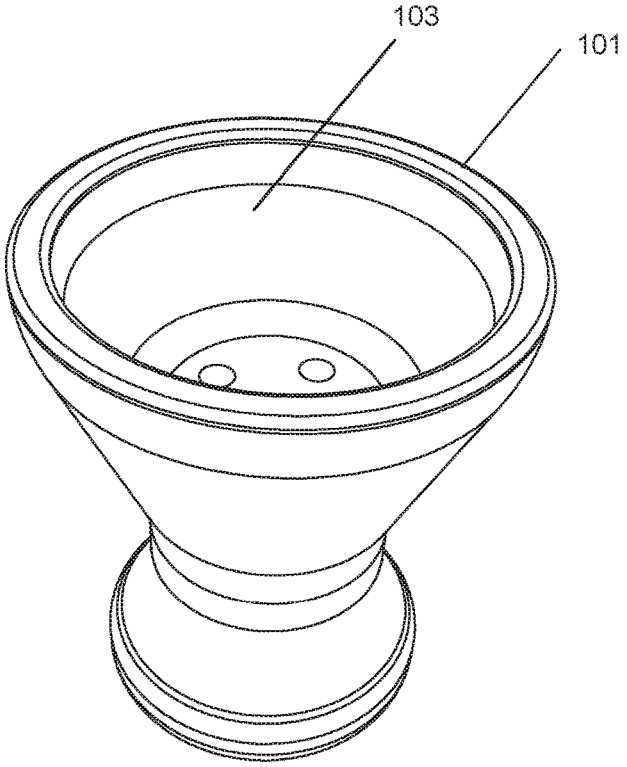
FIG. 15 depicts the top cup (101).
Figure 16:
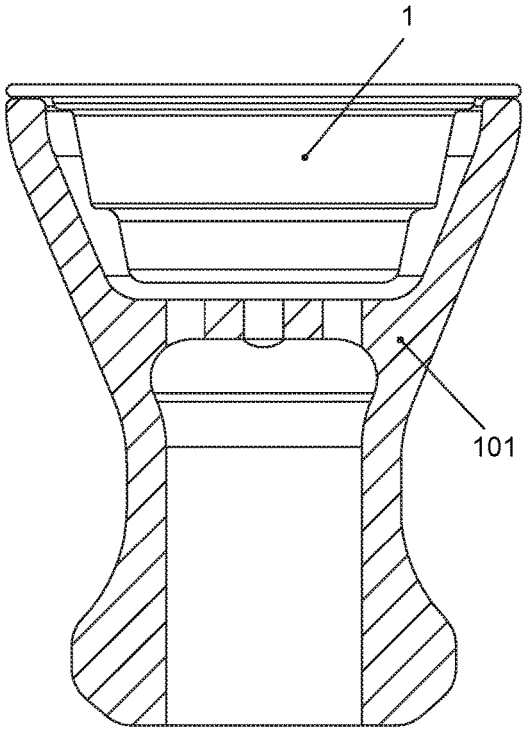
FIG. 16 is a sided cross-sectional view of the top cup (101) and the capsule (1).
Figure 17:
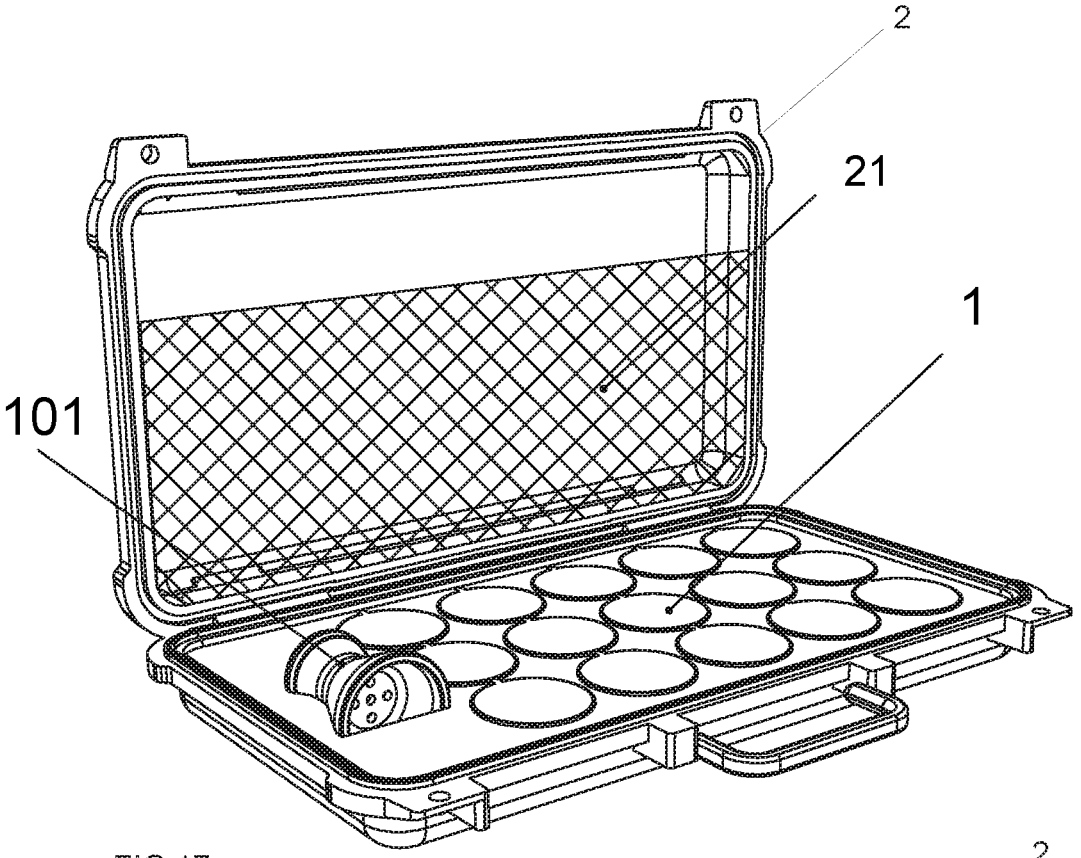
FIG. 17 depicts the casing (2) with several capsules (1), one top cup (101) and a compartment (21).
Figure 18:
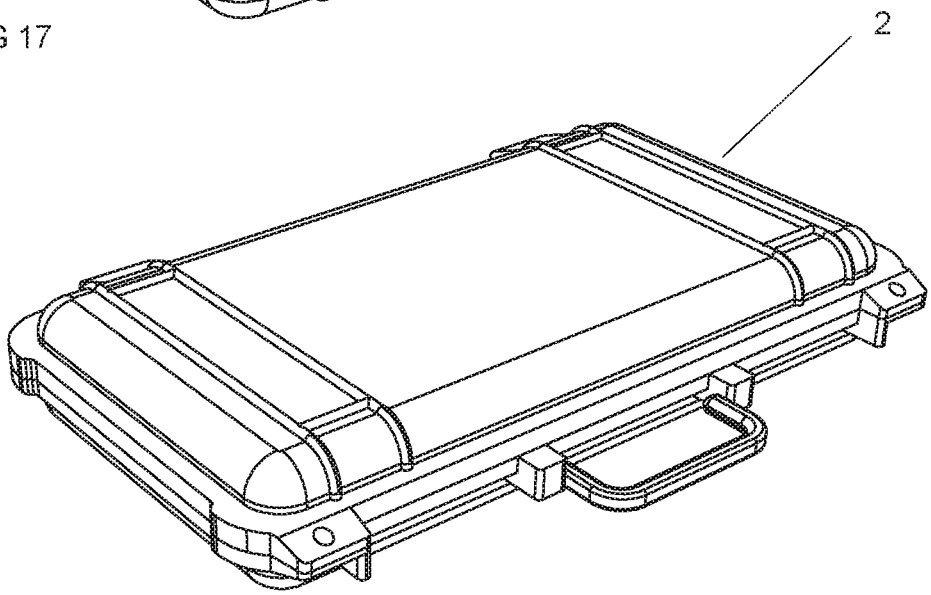
FIG. 18 depicts the casing (2) in closed position.

FIG. 5 depicts the hookah (100) on which the capsule (1) is assembled; FIG. 6 depicts the capsule (1) when it closed; FIG. 7 depicts the top cup (101); FIG. 8 depicts the casing (2) that includes several capsules and one top cup; FIG. 9 is an exploded depiction of the hookah (100), the top cup (101) and the capsule (1); FIG. 10 depicts the capsule (1) when it is closed; FIG. 11 depicts the capsule (1) when the removable sealing means (18) on its top is partially removed; FIG. 12 is a side view depiction of the capsule (1); FIG. 13 is an exploded depiction of the capsule (1), its grids (16) and the upper surface (12); FIG. 14 is a sided cross-sectional view of the capsule (1); FIG. 15 depicts the top cup (101); FIG. 16 is a sided cross-sectional view of the top cup (101) and the capsule (1); FIG. 17 depicts the casing (2) with several capsules (1), one top cup (101) and a compartment (21) for empty used capsules; and FIG. 18 depicts the casing (2) in closed position.

What is claimed is:

1. A sealed tobacco capsule designed to be positioned onto or inside a cup of a hookah, comprising:

an upper surface;

a lower surface;

sidewalls configured to fit into said cup with said lower surface facing downwards toward a fitting for the hookah and said upper surface facing upward towards an upper opening of the cup;

an enclosed internal volume enclosed between said upper surface and said lower surface and surrounded by said sidewalls;

a first plurality of apertures in said upper surface and a second plurality of apertures in said lower surface configured for allowing airflow through said tobacco capsule;

a first removable seal covering said first plurality of apertures of said upper surface;

a second removable seal covering said second plurality of apertures of said lower surface thereby sealing said enclosed volume between said first removable seal and said second removable seal;

a grid that separates said container into at least an upper compartment in contact with said upper surface and separated from said lower surface by said grid and a lower compartment in contact with said lower surface and separated from said upper surface by said grid;

a quantity of tobacco divided with a first portion of the tobacco in said upper compartment and a second portion of the tobacco in said lower compartment such that said grid prevents said first portion of tobacco from being compressed together with the second portion of the tobacco;

wherein said capsule is designed to be positioned onto or inside a cup of said hookah such that after removing said first removable seal and said second removable seal air entering said hookah through said upper surface into said upper compartment and from said upper compartment through said grid to said lower compartment and from said lower compartment through said lower surface into said hookah.

2. The tobacco capsule for hookah according to claim 1, further includes one or more steps on an inner surfaces of said sidewalls on which said grid is positioned.

* * * * *